US005901380A

United States Patent [19]

Mishal

[11] Patent Number: 5,901,380

[45] Date of Patent: May 11, 1999

[54] CAP WITH VIEW OCCLUDING DRAPE

[76] Inventor: Samuel Mishal, 3219-M Post Woods Dr., NW, Atlanta, Ga. 30339

[21] Appl. No.: 08/923,283

[22] Filed: Sep. 4, 1997

[51] Int. Cl.[6] ..... A42B 1/06

[52] U.S. Cl. ..... 2/172; 2/6.3; 2/10; 2/195.1; 2/202; 2/209.13

[58] Field of Search ..... 2/9, 172, 173, 2/195.1, 202, 206, 207, 424, 6.1, 6.2, 6.3, 10, 209.13

[56] References Cited

U.S. PATENT DOCUMENTS

| | | |
|---|---|---|
| 3,100,896 | 8/1963 | Khanbegian . |
| 4,091,469 | 5/1978 | Davidson . |
| 4,180,868 | 1/1980 | Snow . |
| 4,887,319 | 12/1989 | Daniels . |
| 4,980,928 | 1/1991 | Ellis . |
| 5,153,943 | 10/1992 | Clement . |
| 5,212,837 | 5/1993 | Gose et al. . |
| 5,493,734 | 2/1996 | Nieves-Rivera . |
| 5,519,895 | 5/1996 | Barnes, Jr. . |

OTHER PUBLICATIONS

Richard B. Weeghman, "In Search of a Good Hood", *The Aviation Consumer*, pp. 10–11 (Dec. 1982).

Alton K. Marsh, "Briefly Noted", *AOPA Pilot*, p. 118 (Jul. 1997).

Advertisements, *Sporty's Pilot Shop*, p. 23 (Feb.–May 1997).

*Primary Examiner*—Diana L. Biefeld

*Attorney, Agent, or Firm*—Jones & Askew, LLP

[57] ABSTRACT

An Instrument Meteorological Conditions Simulation Device including a headpiece and a drape having a viewing aperture laterally translated from the centerline of the headpiece. The off-center viewing aperture provides a pilot wearing the IFR training hood with an asymmetric field-of-view, which allows a pilot using the IFR training hood to view an entire instrument panel, while excluding outside visual references. The IFR training hood can be implemented by single-piece construction, or by two-part construction using hook-and-pile type fasteners, or other suitable fasteners, to connect the drape to the headpiece. A two-part construction allows retro-fitting the IFR training hood to a pilot's cap or visor.

16 Claims, 5 Drawing Sheets

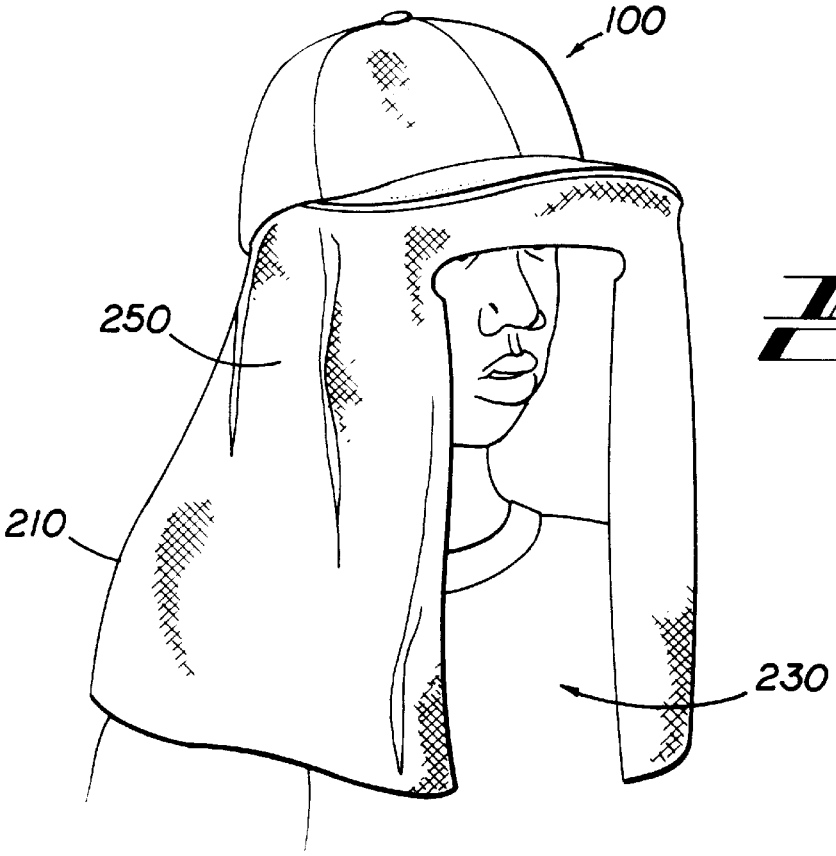
Fig 8
Fig 9
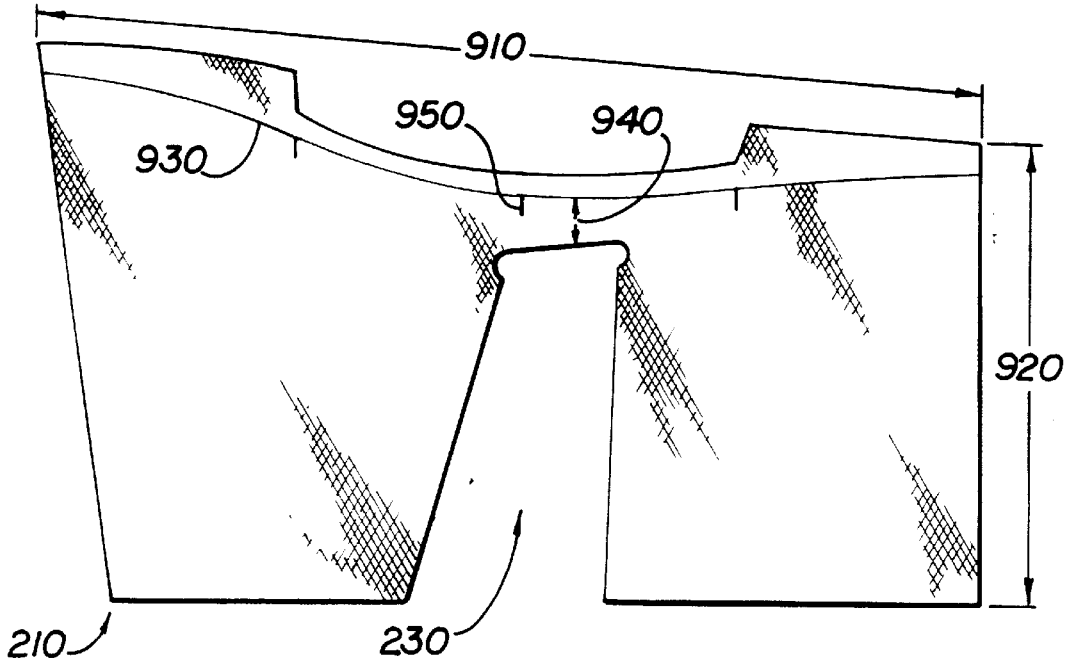

CAP WITH VIEW OCCLUDING DRAPE

FIELD OF THE INVENTION

The present invention relates to the field of aviation training aids, and more particularly relates to an improved Instrument Meteorological Conditions ("IMC") simulation device or Instrument Flight Rules ("IFR") training device which can attach easily to a headpiece, asymmetrically limits a pilot's vision to the instrument panel of an airplane, and wears comfortably over an aviation headset and glasses.

BACKGROUND OF THE INVENTION

To obtain Instrument Flight Rules certification, a pilot must be trained to fly in Instrument Meteorological Conditions, with his or her vision occluded to the instrument panel of the airplane. Accordingly, a pilot must train for IFR certification by simulating IMC flying conditions. To achieve IMC simulation, a pilot can wear various training devices, such as hoods, visors, or glasses to block outside visual references. For the purposes of this discussion, the terms "IMC simulation" and "IFR training" will be used interchangeably. Existing IFR training devices are available which can restrict the pilot's field-of-view, but they are plagued with practical problems.

One existing IFR training device mounts to a pilot's headset. The headset-mounted device attaches to the flat metal stirrups found on some general aviation headsets. The headset-mounted device is constructed of a hard, opaque material and essentially surrounds the eyes of the pilot. The headset-mounted device has a forward viewing aperture which defines the wearer's field-of-view. Two pivoting arms allow the device to be manually raised and lowered. Although the device will accommodate some general aviation headsets, it cannot be worn with all types of headsets. Specifically, the device is limited to operation with selected aviation headsets from certain manufacturers.

Another problem with the headset-mounted device is that when engaged, the pilot cannot look down easily, which is often required in order to see navigational maps. The viewing aperture occludes the pilot's vision not only on the sides, but at the bottom of the device as well. Consequently, the pilot must either crane his neck downward, or use one hand to tilt the device upwards, neither solution being desirable. Repeatedly craning the neck downward increases the possibility that the pilot will suffer vertigo and become partially disoriented. Tilting the headset-mounted device upwards defeats the intended purpose of preventing outside visual references from being introduced.

A second existing IFR training device is a visor-type device. The visor-type device is typically either an attachable-hood style, or an integral visor-hood combination. The attachable-hood style device typically provides a hood that removably attaches to the bill of a visor or cap. The integral-hood style device is typically constructed such that the hood and the visor or cap are not detachable. Both styles share similar features. For both styles, the hood part has a forward portion, which extends forward from the bill of the visor or cap, and side portions, which extend downward from either side of the forward portion.

The visor-type device occludes the pilot's vision over the top of the instrument panel, but the design still allows excessive visual references in the pilot's peripheral vision. Moreover, the visor-type device occludes the pilot's vision equally on both the right and left sides. When the pilot sits in the cockpit of an IFR training-compatible airplane, the instrument panel is asymmetrically displaced about the pilot.

In other words, when sitting in the left seat, there is more of the instrument panel to the right of the pilot than to the left. During IFR training, the pilot's field-of-view should include the entire instrument panel, but exclude all visual references above and to the sides of the instrument panel. Therefore, the pilot's field-of-view should be occluded asymmetrically to match the asymmetric displacement of the instrument panel about the pilot. In other words, when sitting in the left seat, the pilot should be able to see more to the right than to the left for a realistic IMC simulated environment, and vice versa.

Another IFR training device is a fogged-glasses device, which is visibly similar to protective glasses worn by a carpenter or craftsman. The pilot's viewing area is defined by an opaque or translucent treatment applied to the lenses of the goggles or glasses such that the wearer's vision is occluded to an instrument panel. These goggles, adapted for use as IFR training devices, suffer from several problems. First, wearing the device over regular glasses is very difficult and uncomfortable. The viewing area defined by the opaque treatment is symmetric, so the wearer's field-of-view is not skewed to one side. Moreover, the viewing area of the goggles allows excessive visual references to be introduced into the pilot's peripheral vision.

Additional problems with the glasses-type device are that many wearers complain that the device causes headaches from the pressure applied to the head by the earpieces, and the lenses often fog from perspiration during use. The lenses of the device are also susceptible to being scratched.

Yet another IFR training device is a mask-type device similar to a scuba diver's mask, held in place by an elastic headband. This mask-type device is constructed of an opaque, lightweight, shock-resistant plastic, and provides a small viewing aperture defining the pilot's field-of-view.

The mask-type device suffers from many of the same problems as the other existing devices. It is difficult to remove because the device is secured to the wearer's head with an elastic band that can become tangled with the pilot's headset and aviation goggles. Like the headset-mounted device, the mask-type device does not allow the pilot to look down easily. Also, because of the design, many pilots complain that the mask-type device is too snug and confining, almost creating a claustrophobic feeling while wearing it. Moreover, the pilot's field-of-view is not asymmetrically occluded.

Therefore, a practical IFR training device which can be comfortably worn over conventional aviation headsets and eyeglasses, which can constrict the pilot's field of view in an asymmetric manner, and which can adequately eliminate external references from the pilot's peripheral vision, has proven elusive to those skilled in the art. Accordingly, a need exists for an IFR training device that meets each of the above-described requirements.

SUMMARY OF THE INVENTION

The present invention meets the above-described needs by providing an improved IMC simulation device which restricts a pilot's peripheral vision, asymmetrically restricts the pilot's vision to the instrument panel of an airplane, attaches easily to a headpiece, such as a cap or visor, and wears comfortably over any conventional aviation headset and eyeglasses.

Generally described, the present invention provides an improved IFR training hood which is either permanently affixed to, or removably attached to a headpiece, such as a baseball-style cap. The present invention provides a drape that is typically constructed of an opaque, flexible, cloth-like material. The drape can attach to the periphery of a bill protruding from the front of the cap, or be constructed integral to the cap. The drape hangs from the cap such that it encloses the wearer's head, thereby excluding outside visual references. The drape includes an off-center viewing aperture through which the wearer, typically a pilot, can see an aircraft's instrument panel.

The off-center viewing aperture provides the benefit of creating an asymmetric field-of-view for the pilot. An IFR training hood constructed in accordance with the present invention can be comfortably worn over muff-style headsets, glasses, or other aviation accessories, and is compact enough to be easily stored in a flight bag. Moreover, by protruding from the forehead of the pilot, the present invention provides sufficient clearance to avoid the claustrophobic-feeling associated with some existing IFR training devices. The present invention is easy to put on and take off quickly. It is compact and light and can be easily stowed in a flight bag.

Another benefit of the present invention is that it has alternative uses. For instance, an IFR training hood according to the present invention can be used as an emergency aid. In the unlikely event that a pilot is forced to crash land in an area with a undesirable climate, the IFR training hood can be used as a weather shield. Moreover, the drape portion, if constructed of a cloth-like material, can serve as a bandage or tourniquet if necessary. These and many other alternative uses and benefits will become apparent to those skilled in the art upon a review of the following detailed description and drawings.

It is therefore an object of the present invention to provide an improved Instrument Flight Rules training hood which can restrict a pilot's field of view to the instrument panel of an airplane in an asymmetric manner, and which excludes outside visual references above and to the sides of the instrument panel.

It is another object of the present invention to provide an improved Instrument Flight Rules training hood which can be easily and quickly removed and donned, and can be stored without damaging other items kept in the pilot's flight bag, without adding excessive weight, and without requiring excessive space.

It is another object of the present invention to provide an improved Instrument Flight Rules training hood which can be comfortably worn over standard eyeglasses, various headsets, or other accessories.

It is a further object of the present invention to provide an improved Instrument Flight Rules training hood which can also serve as an emergency aid device.

The various aspects of the present invention may be more clearly understood and appreciated from a review of the exemplary embodiments discussed in the following detailed description and the attached drawings.

BRIEF DESCRIPTION OF THE DRAWINGS

FIG. 8 is a perspective view of an IFR training device in accordance with an exemplary embodiment of the present invention.

FIG. 9 is a disassembled view of the drape of an IFR training device in accordance with an exemplary embodiment of the present invention.

DETAILED DESCRIPTION OF THE DISCLOSED EMBODIMENT

Figure 1A:
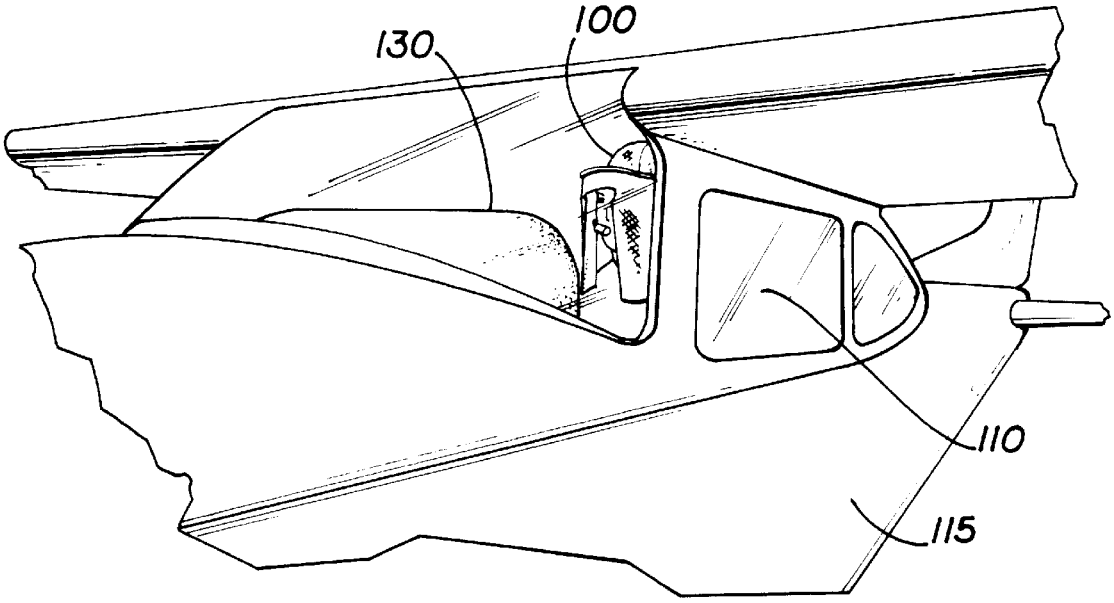
FIGS. 1*a* and 1*b* illustrate the typical environment of the present invention, including a pilot wearing an exemplary embodiment of the present invention.

The present invention is directed to an improved IFR training hood including a headpiece and a drape. The drape includes a viewing aperture laterally translated from the centerline of the headpiece. The off-center viewing aperture provides the pilot with an asymmetric field-of-view, allowing the pilot to view an entire instrument panel, without introducing unwanted visual references from the sides. The viewing aperture further includes an upper band which helps exclude visual references above the top of the instrument panel.

Referring now to the drawings, in which like numerals represent like elements throughout the several figures, aspects of the present invention will be shown embodied in various disclosed embodiments of an IFR training hood.

Figure 1B:
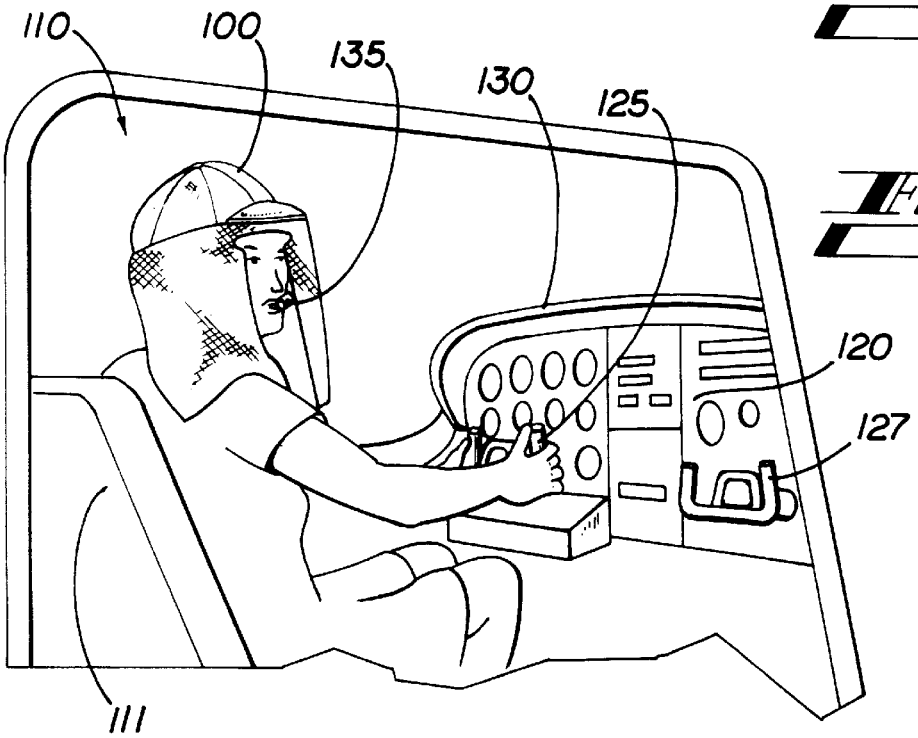

FIGS. 1*a* and 1*b* show a pilot wearing an IFR training hood 100 according to an exemplary embodiment of the present invention. The pilot is sitting in the cockpit 110 of an IFR training-compatible airplane 115. Two airplane manufacturers that make many of the airplanes typically used for IFR training are Cessna Aircraft Company and The New Piper Aircraft, Inc. Those skilled in the art will understand that airplanes 115 manufactured by those companies are generally of a similar construction, and share many of the same physical dimensions within the cockpit 110, including an instrument panel 120.

Inside the cockpit 110 are two seats, one for a pilot 111 and one for the trainer (not shown). In front of the seats is the instrument panel 120. Above the instrument panel 120 is a glare shield 130 which prevents the sun's rays from interfering with the pilot's view of the gauges on the instrument panel 120. Protruding from the instrument panel 120 are two control wheels, a primary control wheel 125 and a secondary control wheel 127.

Within the cockpit 110, the pilot generally sits in the seat addressing the primary control wheel 125. The pilot does not sit directly in the center of the instrument panel 120, but rather sits skewed to one side. Accordingly, more of the instrument panel 120 is to the right side of the pilot than to the left. This arrangement makes it desirable to occlude the pilot's vision in an asymmetric manner, such that the pilot can see all of the instrument panel both to the left and to the right, yet still prevent visual references from being introduced above the glare shield 130. It may sometimes be desirable for the pilot to sit in the seat addressing the secondary control wheel 127. Accordingly, an alternative embodiment of the present invention is envisioned which addresses the need for the pilot to see more to the left than to the right, as discussed in more detail below.

While flying, a pilot generally wears a muff-style aviation headset with a microphone in order to keep in contact with air traffic controllers, other aircraft, and the like. During IFR training, the pilot typically wears the IFR training hood 100 over the headset. Because it includes an adjustable or elastic strap at the rear of the headpiece, shown in FIG. 2, the IFR training hood 100 can be sized to fit comfortably over the pilot's aviation headset. By wearing the IFR training hood 100 over the headset, rather than underneath as with certain existing IFR training devices, the pilot can remove the hood 100 without removing the headset. This provides for quick one-handed removal of the IFR training hood 100. Moreover, the internal volume of the IFR training hood 100 can comfortably accommodate the pilot's use of aviation glasses or eyeglasses.

Turning now to FIGS. 1*b*, 2, 3, and 4, an exemplary embodiment of an IFR training hood 100 constructed in accordance with an exemplary embodiment of the present invention is shown. The hood 100 includes a drape portion 210 and a cap portion 220. The cap portion 220 includes a bill 225, which has a centerline 227 dividing the left half of the bill 225 from the right half.

The cap portion 220 of the disclosed embodiment is a generally-available baseball-style cap. Other caps or head-gear with a bill, such as visors or the like, can similarly be used without departing from the spirit of the present invention. The cap portion 220 also can include an adjustable strap 235 that allows the pilot to adjust the fit of the cap portion 220 to accommodate a muff-style headset. The adjustable strap 235 can be of any conventional construction, including discrete-adjustment types or continuous-adjustment (elastic-band) types. The elastic-band type of adjustable strap 235 may be desirable because it allows the cap portion to fit snugly over a headset.

In the disclosed embodiment, the drape 210 is sewn to the cap portion 220 along a bottom edge 236 of the cap portion 220, and along a periphery 237 of the bill 225. Alternative methods of attachment will be readily apparent to those skilled in the art, such as the alternative embodiment discussed below with respect to FIG. 10, as well as other known methods, such as the use of rivets, staples, glue, or the like, which can provide permanent or temporary attachment. The drape 210 can be constructed of a cloth-like material, such as cotton, linen, polyester or the like. However, it is a necessary aspect of this embodiment of the present invention that the material selected for the drape 210 be substantially opaque or translucent.

Figure 2:
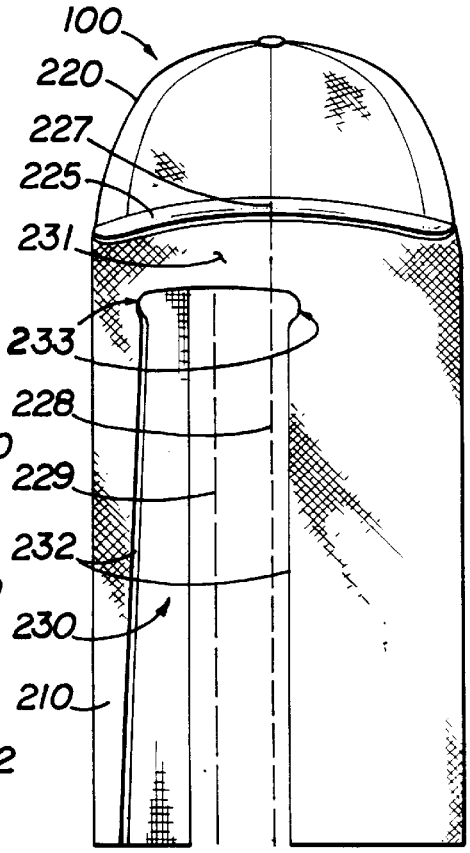
FIG. 2 is a front view of an IFR training device in accordance with an exemplary embodiment of the present invention.

The drape 210 includes a viewing aperture 230 which provides a pilot with a field-of-view. FIG. 2 shows a projected centerline 228, which represents the centerline 227 of the bill 225 extrapolated downward onto the drape 210. It can be seen that the aperture centerline 229 is laterally translated a predetermined distance from the projected centerline 228. Translating the viewing aperture from the projected centerline 228 provides an asymmetric field of view for the pilot.

The viewing aperture 230 of the disclosed embodiment is translated to the right (starboard) side of the drape 210. This allows a pilot to see the entire instrument panel when sitting in the left seat 111 of an airplane cockpit. It will be apparent to those skilled in the art that another embodiment of the present invention can be constructed having the viewing aperture 230 translated to the left (port) side for use when a pilot is sitting in the right seat of an airplane cockpit, without departing from the spirit of the invention.

The viewing aperture 230 is defined above by a substantially-horizontal upper band portion 231 extending a certain distance downward from the bill 225 of the cap portion 220. The upper band portion 231 operates to prevent the pilot from seeing over the top of the glare shield 130 of the airplane 115. In this manner, the upper band portion 231 excludes viewing of outside visual references above the instrument panel 120 of the airplane 115.

The viewing aperture 230 is defined to the sides by downward-extending, substantially vertical edges 232. In the described embodiment, the vertical edges 232 extend along the length of the drape 210 to prevent the drape from hindering the pilot's view downward. Thus, while wearing the hood 100, the pilot is able to glance at any navigational maps or charts which may be laying in the pilot's lap.

In the disclosed embodiment, the viewing aperture 230 also includes a pair of semi-circular, recessed "bulge areas" 233 near the top of each side of the viewing aperture 230. The bulge areas 233 are slight semi-circular recessions of the vertical edges 232 of the viewing aperture 230. The bulge areas 233 further refine the pilot's field-of-view.

Figure 3:
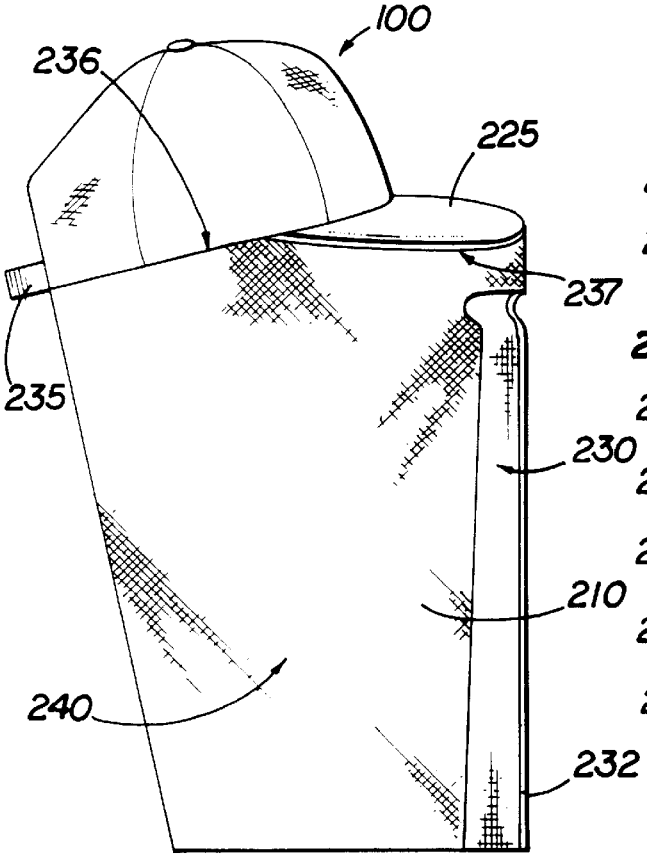
FIG. 3 is a view of the right side of an IFR training device in accordance with an exemplary embodiment of the present invention.
Figure 4:
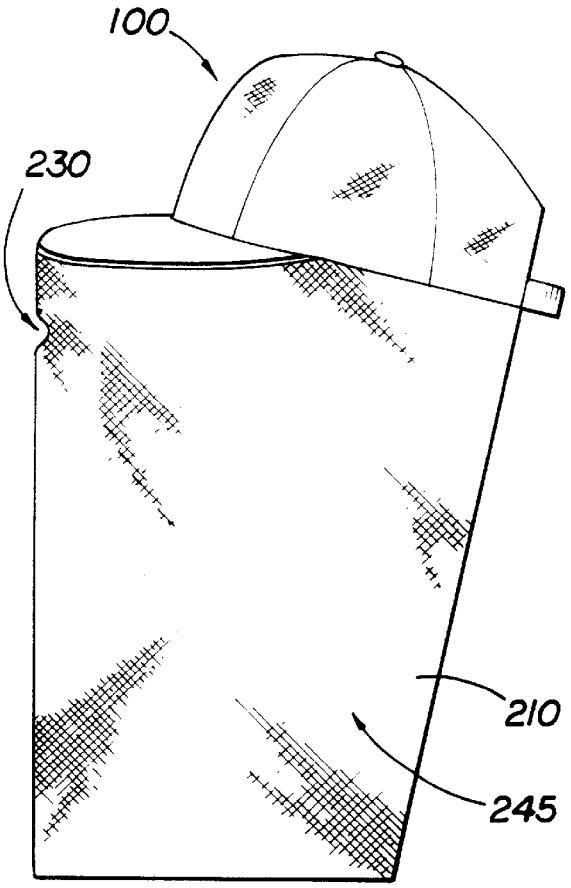
FIG. 4 is a view from the left side of an IFR training device in accordance with an exemplary embodiment of the present invention.

In FIGS. 2, 3 and 4, it is apparent that the viewing aperture 230 of the disclosed embodiment is translated slightly to the right (starboard) side 240 of the hood 100. The left side 245 of the hood 100 reveals a smaller portion of the viewing aperture 230. Accordingly, the hood 100 excludes more visual references to the left side. When worn, the hood 100 provides the pilot with a greater field-of-view to the right side. This improvement overcomes the problem created by the instrument panel 120 being displaced asymmetrically about the pilot. The hood 100 enables the pilot to see all of the right side of the instrument panel 120, without introducing unwanted visual references from the left side. Therefore, the disclosed embodiment improves over the prior art by providing an asymmetric field-of-view for instrument flight rules training.

Figure 5:
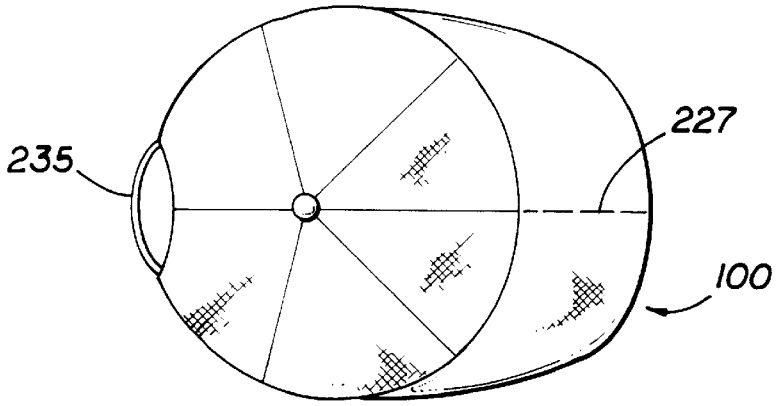
FIG. 5 is a view from the top of an IFR training device in accordance with an exemplary embodiment of the present invention.
Figure 6:
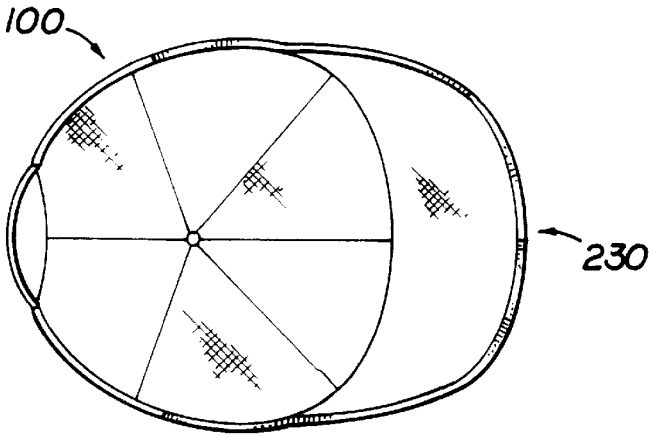
FIG. 6 is a view from the bottom of an IFR training device in accordance with an exemplary embodiment of the present invention.

FIGS. 5 and 6 depict top and bottom views, respectively, of the hood 100. In FIG. 5, the bill centerline 227 is clearly shown. In FIG. 6, the viewing aperture 230 is visible. The distance that the viewing aperture 230 is translated from the projected centerline 228, together with the width of the viewing aperture 230, define the pilot's field-of-view. The viewing aperture 230 of the disclosed embodiment is discussed in more detail below with respect to FIG. 9.

Figure 7:
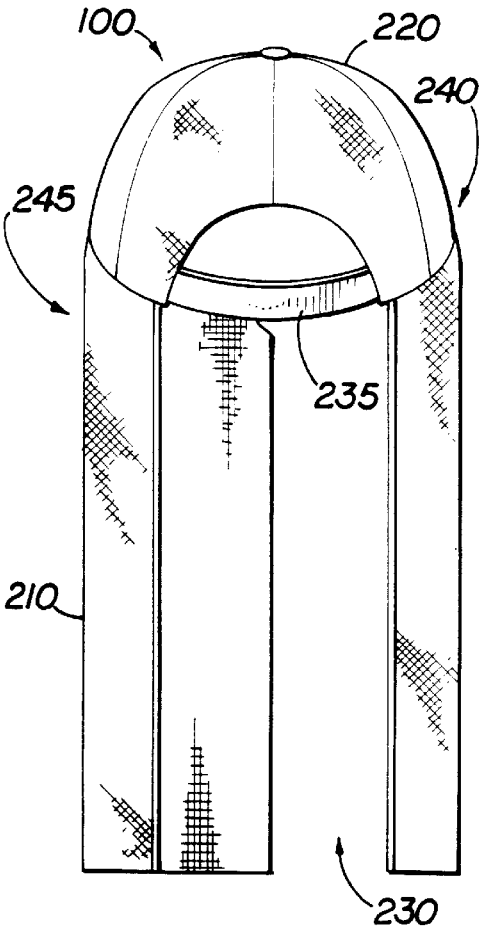
FIG. 7 is a rear view of an IFR training device in accordance with an exemplary embodiment of the present invention.

FIG. 7 is an illustration of a back view of the hood 100. The drape 210 preferably does not continue completely around the cap 220. Instead, the drape 210 of the disclosed embodiment begins at approximately the location of the adjustable strap 235 on the left side 245, continues forward around the bottom of the cap portion 220 and the periphery of the bill 225, and terminates at the back of the cap portion 220, roughly at the location of the adjustable strap 235 on the right side 240. The discontinuity of the drape 210 at the rear of the cap 220 makes removal of the hood 100 easier than if the drape 210 completely surrounded the pilot's head. The hood 100 can simply be pulled forward and removed, rather than having to be pulled completely up and off of the head of the pilot. This improvement overcomes the problems in the prior art with existing IFR training devices that are affixed to the pilot's headset such that removal with one hand is not practical. An IFR training hood 100 constructed in accordance with this exemplary embodiment can be easily removed with one hand at the conclusion of IFR training, or when it becomes necessary to look outside the plane, such as for landing.

FIG. 8 is a perspective view of the IFR training hood 100 as typically worn by a pilot. It is apparent from FIG. 8 that the hood 100 occludes the pilot's view to the viewing aperture 230. As noted above, a pilot often needs to look down in order to view maps or charts which may be located in the pilot's lap. The disclosed embodiment provides the ability for the pilot to glance downward without moving his head, thereby avoiding potential vertigo. The viewing aperture 230 preferably extends down the entire length of the drape 210. Accordingly, the pilot does not have to move his head or reposition the hood 100 in order to glance downward.

The hood 100 can also be comfortably worn over a muff-style headset 250 (under the drape 210) without interference. The lithe and supple nature of the drape 210 easily accommodates the headset 250, without significantly deforming the drape 210. Unlike some existing IFR training devices, the IFR training hood 100 accommodates nearly all makes of conventional aviation headsets.

FIG. 9 is an illustration of the drape 210 prior to attachment to the cap 220. The drape 210 is typically prepared from a conventional fabric, such as cotton, linen, polyester or the like. The overall width 910 of the drape is a function of the size of the cap. The width 910 of the drape 210 should be sufficient to span the distance from one side of the rear of the cap 220, forward around the periphery of the bill 225, and back to the other side of the rear of the cap 220. It is not necessary that the drape 210 completely surround the pilot's head, as his peripheral vision does not extend completely around his head. Rather, the width 910 of the drape 210 should be sufficient to surround so much of the pilot's head as to include the pilot's entire peripheral vision. As mentioned above, a discontinuity of the drape 210 at the rear of the cap 220 is desirable as it eases removing the hood 100 at the conclusion of IFR training.

The overall height 920 of the drape 210 is preferably sufficient to allow the drape 210 to hang over an aviation headset and extend completely to the shoulders of the pilot. Otherwise, the potential exists that outside visual references may be introduced below the drape 210.

The viewing aperture 230 is an opening cut out of the fabric of the drape 210. Those skilled in the art will understand that the cut-out for the viewing aperture 230 should taper outward toward the bottom of the fabric in order to compensate for the curvature of the drape 210 when attached to the cap 220. The dimensions of the viewing aperture 230 will depend upon the application of the particular embodiment. It is envisioned that embodiments of the present invention will be constructed having viewing apertures sized to create an appropriate field-of-view for many different types of airplanes, each having a particular instrument panel configuration. Accordingly, the present invention is not to be limited by any particular dimensions or configurations, including the left-hand or right-hand translation of the viewing aperture 230, described by reference to the disclosed embodiment.

Line 930 is the attachment line of the drape 210 to the cap 220. Accordingly, the distance 940 to the top of the viewing aperture 230 from line 930 should be sufficient to allow the drape 210 to exclude visual references above the glare shield 130 within the cockpit of an airplane.

Point 950 indicates the centerline 227 of the bill 225 when the drape 210 is attached to the cap 220. As discussed above, the viewing aperture 230 is translated from the centerline of the bill 225 in order to create an asymmetric field-of-view for the pilot. In FIG. 9, the viewing aperture 230 is translated to the right of the centerline of the bill 225 because FIG. 9 illustrates the drape 210 as the pilot would view it from inside the cap 220. The amount of translation can vary depending on the particular other dimensions, but should be sufficient to enable a pilot to see only from the right edge of an instrument panel 120 to the left edge.

Figure 10:
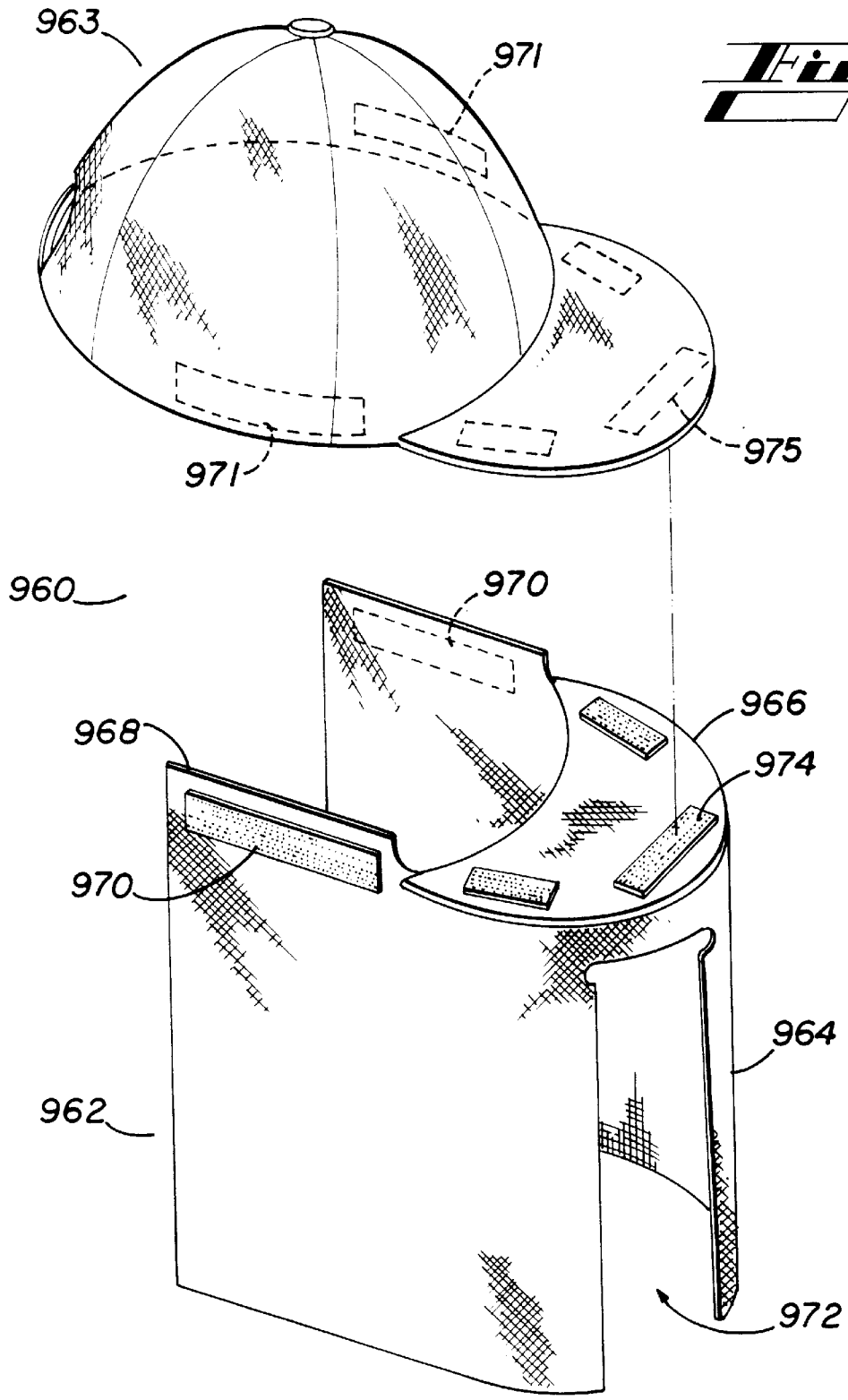
FIG. 10 is an exploded view of an IFR training device in accordance with an alternative exemplary embodiment of the present invention.

FIG. 10 depicts an exploded view of an alternative exemplary embodiment of the present invention. FIG. 10 shows a two-part IFR training hood 960 consisting of a drape portion 962 and a headpiece 963. The headpiece 963 can be a baseball-style cap, a visor, or any other headpiece which can operate to provide support to the drape portion 962. It may be desirable for a pilot to retro-fit an IFR training hood to his existing favorite cap or visor. Likewise, a company may wish to attach an IFR training hood to existing promotional caps or visors, to which a company logo is affixed. Accordingly, this embodiment provides the ability to adapt a desired headpiece to receive the drape portion 962, and thereby temporarily transform the headpiece 963 into an IFR training hood 100 without compromising the normal use of the headpiece.

The drape portion 962 is constructed in two pieces, a drape 964 and a bill 966. The drape 964 and the bill 966 can securely attach to each other by a conventional method, such as sewing or gluing the drape 964 to the bill 966. Unlike the prior embodiment, the drape portion 962 can be removably attached to the headpiece 963. In this manner, the drape portion 962 can be easily separated and stored apart from the headpiece 963.

The drape 964 is constructed substantially the same as the drape 210 of the prior embodiment. However, the upper edge 968 of a drape constructed from cloth is preferably finished so as not to unravel. In most other respects, the drape 964 is similar to the prior embodiment, including the dimensions and positioning of the viewing aperture 972. The viewing aperture 972 is laterally translated from the centerline of the bill 966 of the instant embodiment. At the sides of the drape 964 are hook-and-pile type fasteners 970, such as "VELCRO" fasteners. Attached to the sides of the headpiece 963 are receiving hook-and-pile fasteners 971. The use of hook-and-pile fasteners 970 and 971 provides the ability for the instant embodiment to be easily attached to a pilot's favorite cap or visor, if the pilot so desires. Also, the drape portion 962 can be easily unattached such that the headpiece 963 can be worn as regular street adornment. While the disclosed embodiment makes use of hook-and-pile type fasteners, those skilled in the art will appreciate that many other types of fasteners may be used and still produce an IFR training hood according to the present invention, such as ball-and-socket type fasteners, zippers, snaps or the like.

The bill 966 is constructed of a semi-rigid material, such as cardboard, plastic or the like. The bill 966 can be covered with the same material that the drape 964 is made of, such as cotton or the like. The bill 966 of the disclosed embodiment is substantially crescent-shaped, corresponding to the shape of the bills of many conventional caps. Attached to the bill 966 are hook-and-pile type fasteners 974. The receiving fasteners 975 can be attached to the bill of the headpiece 963 in the same manner as the drape fasteners 971. Accordingly, the alternative embodiment shown in FIG. 10 provides all of the benefits of the previous embodiment, and the additional benefit of being adaptable to a pilot's current cap or visor.

The disclosed embodiments are but examples of IFR training devices constructed in accordance with the present invention. Other applications may warrant additional alternative embodiments constructed in accordance with the present invention. For instance, the disclosed embodiments create a proper asymmetric field-of-view when used in combination with the cockpit of a particular airplane. However, the cockpit of another airplane may have different instrument panel dimensions, thereby warranting variations to the disclosed embodiment to achieve the objects of the present invention. The disclosed embodiments are for disclosure purposes only, and many other embodiments will become apparent to those skilled in the art without departing from the spirit of the invention.

From the foregoing detailed description, it will be appreciated that the present invention provides an improved IFR training hood which includes a headpiece and a drape. The drape further includes a viewing aperture translated from the centerline of the headpiece. The off-center viewing aperture provides the pilot with an asymmetric field-of-view, which allows the pilot to view an entire instrument panel, without introducing unwanted outside visual references.

In an alternative embodiment, the IFR training hood is of a two-part construction, joined with hook-and-pile type fasteners, which allows retro-fitting the IFR training hood to a headpiece, such as a pilot's favorite cap or visor, or a company's existing promotional caps or visors.

The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is defined by the appended claims rather than the foregoing description.

What is claimed is:

1. An Instrument Meteorological Conditions simulation device, comprising:

a headpiece having a protruding bill; and a drape, attached to the headpiece, having a viewing aperture sized to partially occlude a pilot's vision, the viewing aperture positioned off-center with respect to the protruding bill, whereby the drape extends below the headpiece and is adapted to extend proximate to the head of a pilot wearing the headpiece to occlude the pilot's field-of-view of an instrument panel of an airplane.

2. The Instrument Meteorological Conditions simulation device of claim 1, wherein the headpiece is a cap and the drape is permanently attached to the cap.

3. The Instrument Meteorological Conditions simulation device of claim 1, wherein the drape is attached to the headpiece with a fastener.

4. The Instrument Meteorological Conditions simulation device of claim 1, wherein the viewing aperture is an opening in the drape defined by a substantially-horizontal upper band portion of the drape extending a certain distance downward from the bill of the headpiece, and by a pair of downward-extending, substantially vertical edges of the drape.

5. The Instrument Meteorological Conditions simulation device of claim 4, wherein the viewing aperture further comprises a pair of recessed bulge areas positioned adjacent the top of each side of the viewing aperture, the recessed bulge areas being substantially semicircular in shape.

6. The Instrument Meteorological Conditions simulation device of claim 4, wherein the drape is sufficiently voluminous to accommodate glasses and headsets worn underneath the drape.

7. The Instrument Meteorological Conditions simulation device of claim 1, wherein the drape is constructed of a cloth-like material.

8. The Instrument Meteorological Conditions simulation device of claim 1, wherein the drape is attached to the headpiece at a bottom edge of the headpiece extending from a certain location at one side of the headpiece, extending forward along a periphery of the headpiece, along the outer periphery of the bill, and terminating at a certain location on the opposing side of the headpiece.

9. An Instrument Meteorological Conditions simulation device for use with a headpiece, comprising:

a bill constructed of a substantially rigid material, the bill having a centerline and an outer periphery; and a drape attached to the outer periphery of the bill and extending downward from the outer periphery of the bill, the drape extending a certain distance past the bill on both sides, and being constructed of a substantially opaque material, the drape further having a viewing aperture, including a centerline that is displaced laterally a certain distance from the centerline of the bill;

whereby the drape and bill can be removably attached to the headpiece such that the viewing aperture in the drape asymmetrically occludes a pilot's field-of-view to an instrument panel of an airplane.

10. The Instrument Meteorological Conditions simulation device of claim 9, wherein the drape and bill attach to a headpiece with temporary fasteners, such that the drape and bill can be removed and the headpiece can be worn separately.

11. The Instrument Meteorological Conditions simulation device of claim 9, wherein the drape is constructed of a cloth-like material.

12. An Instrument Meteorological Conditions simulation device, comprising:

a headpiece having a bill protruding from the front of the headpiece, the headpiece having two sides and a periphery extending from a location at one side of the headpiece and along the bill to a location at the other side of the headpiece, the bill having a centerline; and a drape portion attached to the periphery of the headpiece and hanging downward from the periphery, the drape portion constructed of a substantially opaque material and having an aperture including a centerline, the centerline of the aperture being displaced laterally a certain distance from the centerline of the bill portion;

whereby the aperture in the drape portion asymmetrically restricts a wearer's field-of-view to an instrument panel of an airplane.

13. The Instrument Meteorological Conditions simulation device of claim 12, wherein the drape portion is permanently attached to the headpiece, such that the drape portion and the headpiece form an integral hood.

14. The Instrument Meteorological Conditions simulation device of claim 13, wherein the aperture extends down substantially the entire length of the drape portion, such that the drape portion does not create a substantial impediment to a pilot glancing down.

15. The Instrument Meteorological Conditions simulation device of claim 12, wherein the drape portion attaches to the headpiece with temporary fasteners, such that the drape portion can be easily detached from the headpiece.

16. The Instrument Meteorological Conditions simulation device of claim 15, wherein the aperture extends down substantially the entire length of the drape portion, such that the drape portion does not create a substantial impediment to a pilot glancing down.

* * * * *